US006234613B1

(12) United States Patent
Feinn et al.

(10) Patent No.: US 6,234,613 B1
(45) Date of Patent: May 22, 2001

(54) APPARATUS FOR GENERATING SMALL VOLUME, HIGH VELOCITY INK DROPLETS IN AN INKJET PRINTER

(75) Inventors: James A. Feinn, San Diego; Scott A. Norum, La Jolla, both of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 08/960,928

(22) Filed: Oct. 30, 1997

(51) Int. Cl.[7] ..... B41J 2/05

(52) U.S. Cl. ..... 347/65

(58) Field of Search ..... 347/63, 65, 67

(56) References Cited

U.S. PATENT DOCUMENTS

| | | | | |
|---|---|---|---|---|
| 4,345,262 | | 8/1982 | Shirato et al. | 347/56 |
| 4,480,259 | * | 10/1984 | Kruger et al. | 347/63 |
| 4,503,444 | | 3/1985 | Tacklind | 347/71 |
| 4,746,935 | | 5/1988 | Allen | 347/15 |
| 4,789,425 | | 12/1988 | Drake et al. | 216/27 |
| 4,794,410 | | 12/1988 | Taub et al. | 346/140 R |
| 4,794,411 | | 12/1988 | Taub et al. | 346/140 R |
| 4,882,595 | | 11/1989 | Trueba et al. | 347/85 |
| 4,963,882 | | 10/1990 | Hickman | 346/1.1 |
| 5,252,986 | | 10/1993 | Takaoka et al. | 347/15 |
| 5,278,584 | | 1/1994 | Keefe et al. | 347/63 |
| 5,541,629 | | 7/1996 | Saunders et al. | 347/12 |
| 5,604,519 | | 2/1997 | Keefe et al. | 347/13 |
| 5,610,637 | | 3/1997 | Sekiya et al. | 347/10 |
| 5,652,609 | | 7/1997 | Scholler et al. | 347/54 |
| 5,657,060 | | 8/1997 | Sekiya | 347/15 |
| 5,729,257 | | 3/1998 | Sekiya et al. | 347/9 |
| 5,874,974 | * | 2/1999 | Courian et al. | 347/65 |
| 5,877,786 | | 3/1999 | Sekiya et al. | 347/15 |

FOREIGN PATENT DOCUMENTS

| | | | |
|---|---|---|---|
| 0259541A | 3/1988 | (EP) . | |
| 0259541A2 | 3/1988 | (EP) | H04N/1/032 |
| 0259541A3 | 3/1988 | (EP) | H04N/1/032 |
| 0367541A2 | 5/1990 | (EP) . | |
| 0495670A1 | 7/1992 | (EP) . | |
| 0498292A2 | 8/1992 | (EP) . | |
| 0507134A2 | 10/1992 | (EP) . | |
| 0517 543 | 12/1992 | (EP) . | |
| 0636482A | 2/1995 | (EP) . | |
| 0638602A1 | 2/1995 | (EP) . | |
| 0728583A2 | 8/1996 | (EP) . | |
| 0749835A2 | 12/1996 | (EP) . | |

(List continued on next page.)

*Primary Examiner*—John Barlow
*Assistant Examiner*—Juanita Stephens
(74) *Attorney, Agent, or Firm*—Dennis G. Stenstrom

(57) ABSTRACT

Disclosed is an inkjet print cartridge including an ink supply, a substrate having a plurality of individual ink ejection chambers defined by a barrier layer formed on a first surface of the substrate and having an ink ejection element in each of the ink ejection chambers, for ejecting drops of ink having a predetermined drop volume and drop velocity. The ink ejection chambers each have the same inlet channel length and are arranged in an array spaced so as to provide a predetermined resolution. A nozzle member having a plurality of ink orifices formed therein is positioned to overlie the barrier layer with the orifices aligned with the ink ejection chambers. An ink channel connects the reservoir with the ink ejection chambers. The inkjet print cartridge has several advantages of over previous printing systems in creating high quality images by using very small individual ink drops of low volume and high velocity. Highlight regions may be formed by using single low volume drops to form a dot. The individual drops are nearly invisible and can be used to form highlights with low graininess. As the density of the image increases, multi-drop dots are formed from two or more drops merging on the media to form a composite drop.

28 Claims, 6 Drawing Sheets

FOREIGN PATENT DOCUMENTS

| | | | |
|---|---|---|---|
| 0763430A2 | 3/1997 | (EP) . | |
| 0767061A2 | 4/1997 | (EP) . | |
| 0769379A1 | 4/1997 | (EP) | 41/2 |
| 0785072A2 | 7/1997 | (EP) . | |
| 0787588A2 | 8/1997 | (EP) . | |
| 0790129A2 | 8/1997 | (EP) . | |
| 0800921A2 | 10/1997 | (EP) . | |
| 63-53052 | 3/1988 | (JP) | B41J/3/04 |
| WO97/48558A | 12/1997 | (WO) . | |

* cited by examiner

APPARATUS FOR GENERATING SMALL VOLUME, HIGH VELOCITY INK DROPLETS IN AN INKJET PRINTER

CROSS-REFERENCE TO RELATED APPLICATIONS

This application is related to U.S. patent application Ser. No. 08/960,927 filed concurrently herewith, entitled "Multi-Drop Merge on Media Printing System"; U.S. patent application Ser. No. 08/960,945 filed concurrently herewith, entitled "Apparatus and Method for Generating High Frequency Ink Ejection and Ink Chamber Refill" and U.S. patent application Ser. No. 08/796,835, filed Feb. 6, 1997, entitled "Fractional Dot Column Correction for Scan Axis Alignment During Printing." The foregoing commonly assigned patent applications are herein incorporated by reference.

FIELD OF THE INVENTION

The present invention generally relates to inkjet printers and more particularly to apparatus and methods for generating photographic quality images on a color inkjet printer.

BACKGROUND OF THE INVENTION

Thermal inkjet hardcopy devices such as printers, large format plotters/printers, facsimile machines and copiers have gained wide acceptance. These hardcopy devices are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. The basics of this technology are further disclosed in various articles in several editions of the *Hewlett-Packard Journal* [Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994)], incorporated herein by reference. Inkjet hardcopy devices produce high quality print, are compact and portable, and print quickly and quietly because only ink strikes the paper.

An inkjet printer forms a printed image by printing a pattern of individual dots at particular locations of an array defined for the printing medium. The locations are conveniently visualized as being small dots in a rectilinear array. The locations are sometimes termed "dot locations", "dot positions", or "pixels". Thus, the printing operation can be viewed as the filling of a pattern of dot locations with dots of ink.

Inkjet hardcopy devices print dots by ejecting very small drops of ink onto the print medium and typically include a movable carriage that supports one or more printheads each having ink ejecting nozzles. The carriage traverses over the surface of the print medium, and the nozzles are controlled to eject drops of ink at appropriate times pursuant to command of a microcomputer or other controller, wherein the timing of the application of the ink drops is intended to correspond to the pattern of pixels of the image being printed.

The typical inkjet printhead (i.e., the silicon substrate, structures built on the substrate, and connections to the substrate) uses liquid ink (i.e., dissolved colorants or pigments dispersed in a solvent). It has an array of precisely formed orifices or nozzles attached to a printhead substrate that incorporates an array of ink ejection chambers which receive liquid ink from the ink reservoir. Each chamber is located opposite the nozzle so ink can collect between it and the nozzle. The ejection of ink droplets is typically under the control of a microprocessor, the signals of which are conveyed by electrical traces to the ink ejection element. When electric printing pulses activate the ink ejection element, a small portion of the ink next to it vaporizes and ejects a drop of ink from the printhead. Properly arranged nozzles form a dot matrix pattern. Properly sequencing the operation of each nozzle causes characters or images to be printed upon the paper as the printhead moves past the paper.

The ink cartridge containing the nozzles is moved repeatedly across the width of the medium to be printed upon. At each of a designated number of increments of this movement across the medium, each of the nozzles is caused either to eject ink or to refrain from ejecting ink according to the program output of the controlling microprocessor. Each completed movement across the medium can print a swath approximately as wide as the number of nozzles arranged in a column of the ink cartridge multiplied by the distance between nozzle centers. After each such completed movement or swath the medium is moved forward the width of the swath, and the ink cartridge begins the next swath. By proper selection and timing of the signals, the desired print is obtained on the medium.

In an inkjet printhead ink is fed from an ink reservoir integral to the printhead or an "off-axis" ink reservoir which feeds ink to the printhead via tubes connecting the printhead and reservoir. Ink is then fed to the various ink ejection chambers either through an elongated hole formed in the center of the bottom of the substrate, "center feed," or around the outer edges of the substrate, "edge feed." In center feed the ink then flows through a central slot in the substrate into a central manifold area formed in a barrier layer between the substrate and a nozzle member, then into a plurality of ink channels, and finally into the various ink ejection chambers. In edge feed ink from the ink reservoir flows around the outer edges of the substrate into the ink channels and finally into the ink ejection chambers. In either center feed or edge feed, the flow path from the ink reservoir and the manifold inherently provides restrictions on ink flow to the ink ejection chambers.

Color inkjet hardcopy devices commonly employ a plurality of print cartridges, usually two to four, mounted in the printer carriage to produce a full spectrum of colors. In a printer with four cartridges, each print cartridge can contain a different color ink, with the commonly used base colors being cyan, magenta, yellow, and black. In a printer with two cartridges, one cartridge can contain black ink with the other cartridge being a tri-compartment cartridge containing the base color cyan, magenta and yellow inks, or alternatively, two dual-compartment cartridges may be used to contain the four color inks. In addition, two tri-compartment cartridges may be used to contain six base color inks, for example, black, cyan, magenta, yellow, light cyan and light magenta. Further, other combinations can be employed depending on the number of different base color inks to be used.

The base colors are produced on the media by depositing a drop of the required color onto a dot location, while secondary or shaded colors are formed by depositing multiple drops of different base color inks onto the same or an adjacent dot location, with the overprinting of two or more base colors producing the secondary colors according to well established optical principles.

In color printing, the various colored dots produced by each of the print cartridges are selectively overlapped to create crisp images composed of virtually any color of the visible spectrum. To create a single dot on paper having a color which requires a blend of two or more of the colors provided by different print cartridges, the nozzle plates on each of the cartridges must be precisely aligned so that a dot ejected from a selected nozzle in one cartridge overlaps a dot ejected from a corresponding nozzle in another cartridge.

The print quality produced from an inkjet device is dependent upon the reliability of its ink ejection elements. The ability to achieve good tone scale is crucial to achieving photographic image quality. In the highlight region of the tone scale, nearly invisible dots and lack of graininess are required. Areas of solid fill require saturated colors, high optical density and no white space. Also, the ability to place more than one nearly imperceptible drop from a given printhead into a pixel is essential to achieving this photographic image quality.

Another solution for achieving good tone scales is to use a six-ink printing system. This approach uses black ink, yellow ink, light cyan ink, dark cyan ink, light magenta ink and dark magenta ink. Good image quality is achieved in highlight regions by using only the yellow, light cyan and light magenta inks. The black, dark cyan and dark magenta inks are used in more saturated areas of the image. The disadvantages of this system are (1) the complexity of having a six-ink system (more inks, more complicated color maps and product cost and size, and (2) transitions that degrade image quality are observed in the tone scale when the dark cyan and dark magenta, which are highly visible, are first used.

Another approach to form different dot sizes is to use multiple drop volumes on the same printhead (See, U.S. Pat. No. 4,746,935). The primary disadvantage of this approach is the need for multiple drop generators which increases cost and complexity.

Even when using the above described methods and apparatus, the creation of crisp and vibrant images with accurate tone equal to those produced by conventional silver halide photography has not been achieved.

Due to the increasing use of digital cameras to produce digital images and the use of scanners to input conventional photographs into personal computers, the demand has rapidly increased for printers which can produce photographic quality prints from these images. Accordingly, there is a need for printers which can produce photographic quality prints.

SUMMARY OF THE INVENTION

The present invention is an inkjet print cartridge including an ink supply, a substrate having a plurality of individual ink ejection chambers defined by a barrier layer formed on a first surface of the substrate and having an ink ejection element in each of the ink ejection chambers, for ejecting drops of ink having a predetermined drop volume and drop velocity. The ink ejection chambers each have the same inlet channel length and are arranged in an array spaced so as to provide a predetermined resolution. A nozzle member having a plurality of ink orifices formed therein is positioned to overlie the barrier layer with the orifices aligned with the ink ejection chambers. An ink channel connects the reservoir with the ink ejection chambers. The present invention also includes a printer wherein the print cartridge is mounted in a scanning carriage.

The present invention has several advantages of over previous printing systems in creating high quality images by using very small individual ink drops of low volume. Highlight regions may be formed by using single low volume drops to form a dot. The individual drops are nearly invisible and can be used to form highlights with low graininess. As the density of the image increases, multi-drop dots are formed from two or more drops merging on the media to form a composite drop. Another advantage of the present invention is that drop velocity and volume are much less sensitive to ink viscosity and surface tension. Previous architectures required higher viscosity inks with higher surface tension which also required media which is not acceptable for high quality photographic imaging. The present invention can utilize inks having much lower viscosities and surface tensions and allows the use of media that closely resembles the paper used in silver halide photographic prints. The present invention's less sensitivity to ink properties permits flexibility in designing an ink that will dry relatively quickly, while not compromising overall ink reliability.

DETAILED DESCRIPTION OF THE PREFERRED EMBODIMENTS

While the present invention will be described below in the context of an off-axis printer having an external ink source, it should be apparent that the present invention is also useful in an inkjet printer which uses inkjet print cartridges having an ink reservoir integral with the print cartridge.

Figure 1:
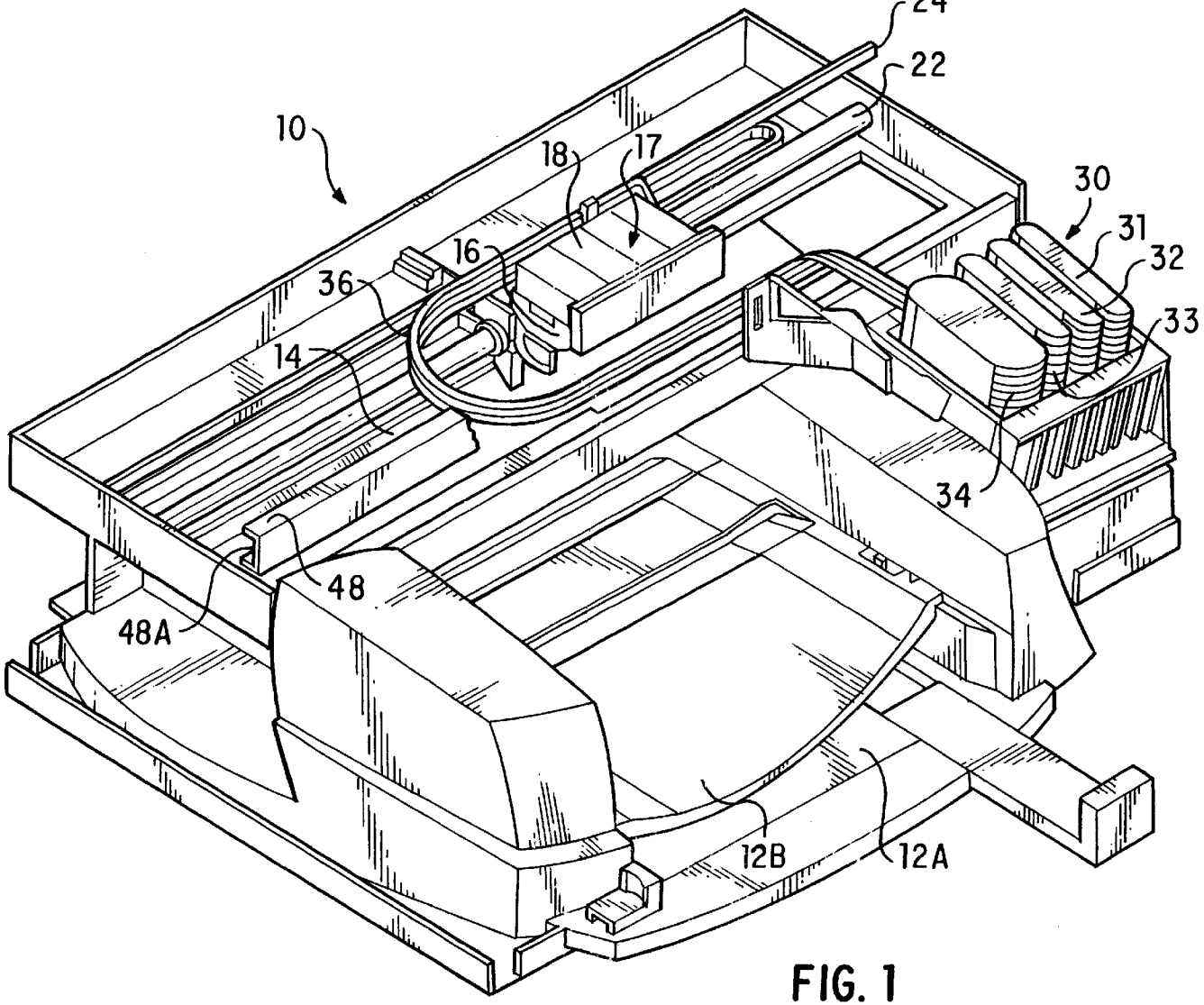
FIG. 1 is a perspective view of one embodiment of an inkjet printer incorporating the present invention.

FIG. 1 is a perspective view of one embodiment of an inkjet printer 10 suitable for utilizing the present invention, with its cover removed. Generally, printer 10 includes a tray 12 for holding virgin paper. When a printing operation is initiated, a sheet of paper from tray 12A is fed into printer 10 using a sheet feeder, then brought around in a U direction to now travel in the opposite direction toward tray 12B. The sheet is stopped in a print zone 14, and a scanning carriage 16, supporting one or more print cartridges 18, is then scanned across the sheet for printing a swath of ink thereon. After a single scan or multiple scans, the sheet is then incrementally shifted using a conventional stepper motor and feed rollers to a next position within the print zone 14, and carriage 16 again scans across the sheet for printing a next swath of ink. When the printing on the sheet is complete, the sheet is forwarded to a position above tray 12B, held in that position to ensure the ink is dry, and then released.

The carriage 16 scanning mechanism may be conventional and generally includes a slide rod 22, along which carriage 16 slides, a flexible circuit (not shown in FIG. 1) for transmitting electrical signals from the printer's microprocessor to the carriage 16 and print cartridges 18 and a coded strip 24 which is optically detected by a photodetector in carriage 16 for precisely positioning carriage 16. A stepper motor (not shown), connected to carriage 16 using a conventional drive belt and pulley arrangement, is used for transporting carriage 16 across print zone 14.

The features of inkjet printer 10 include an ink delivery system for providing ink to the print cartridges 18 and ultimately to the ink ejection chambers in the printheads from an off-axis ink supply station 30 containing replaceable ink supply cartridges 31, 32, 33, and 34, which may be pressurized or at atmospheric pressure. For color printers, there will typically be a separate ink supply cartridge for black ink, yellow ink, magenta ink, and cyan ink. Four tubes 36 carry ink from the four replaceable ink supply cartridges 31–34 to the print cartridges 18.

Figure 2:
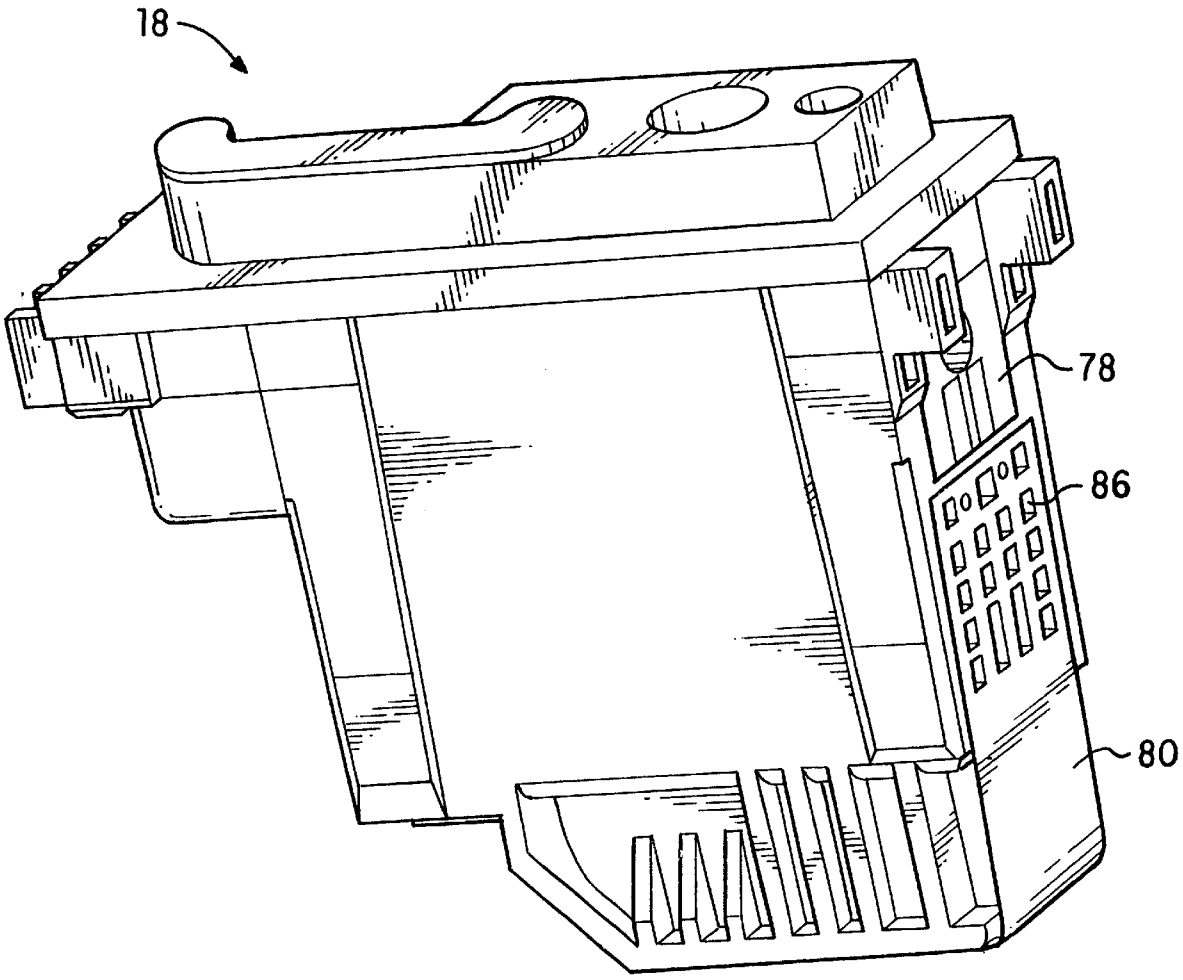
FIG. 2 is a top perspective view of a single print.
Figure 3:
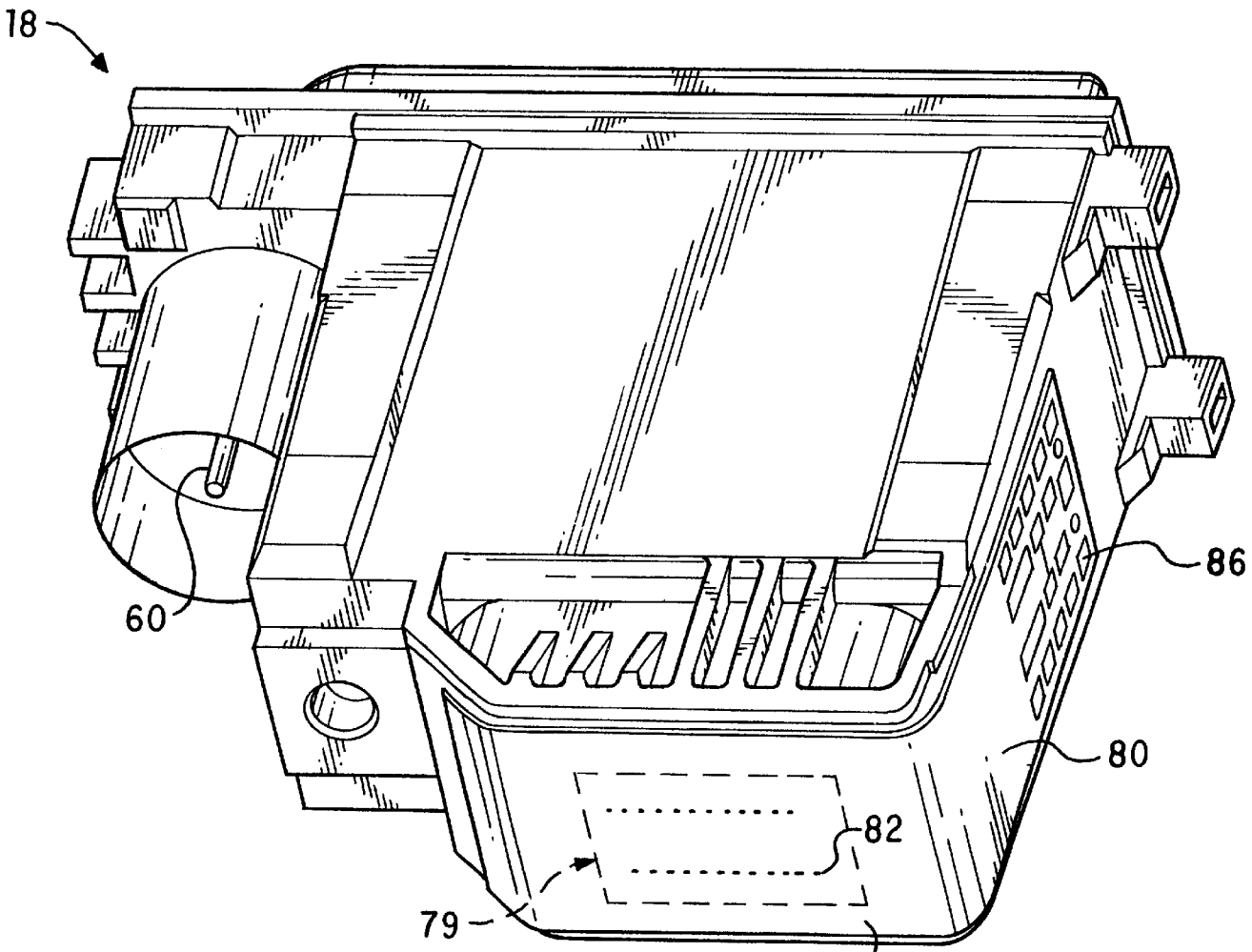
FIG. 3 is a bottom perspective view a single print cartridge.

Referring to FIGS. 2 and 3, a flexible tape 80 containing contact pads 86 leading to electrodes 87 (not shown) on printhead substrate 88 is secured to print cartridge 18. These contact pads 86 align with and electrically contact electrodes (not shown) on carriage 16. An integrated circuit chip or memory element 78 provides feedback to the printer regarding certain parameters such as nozzle trajectories and drop volumes of print cartridge 18. Tape 80 has a nozzle array, or nozzle member, 79 consisting of two rows of nozzles 82 which are laser ablated through tape 80. An ink fill hole 81 is used to initially fill print cartridge 18 with ink. A stopper (not shown) is intended to permanently seal hole 81 after the initial filling.

A regulator valve (not shown) within print cartridges 18 regulates pressure by opening and closing an inlet hole to an ink chamber internal to print cartridges 18. When the regulator valve is opened, hollow needle 60 is in fluid communication with an ink chamber (not shown) internal to the cartridge 18 and the off-axis ink supply. When in use in the printer 10, the print cartridges 18 are in fluid communication with an off-carriage ink supply 31–34 that is releasably mounted in an ink supply station 30.

Figure 4:
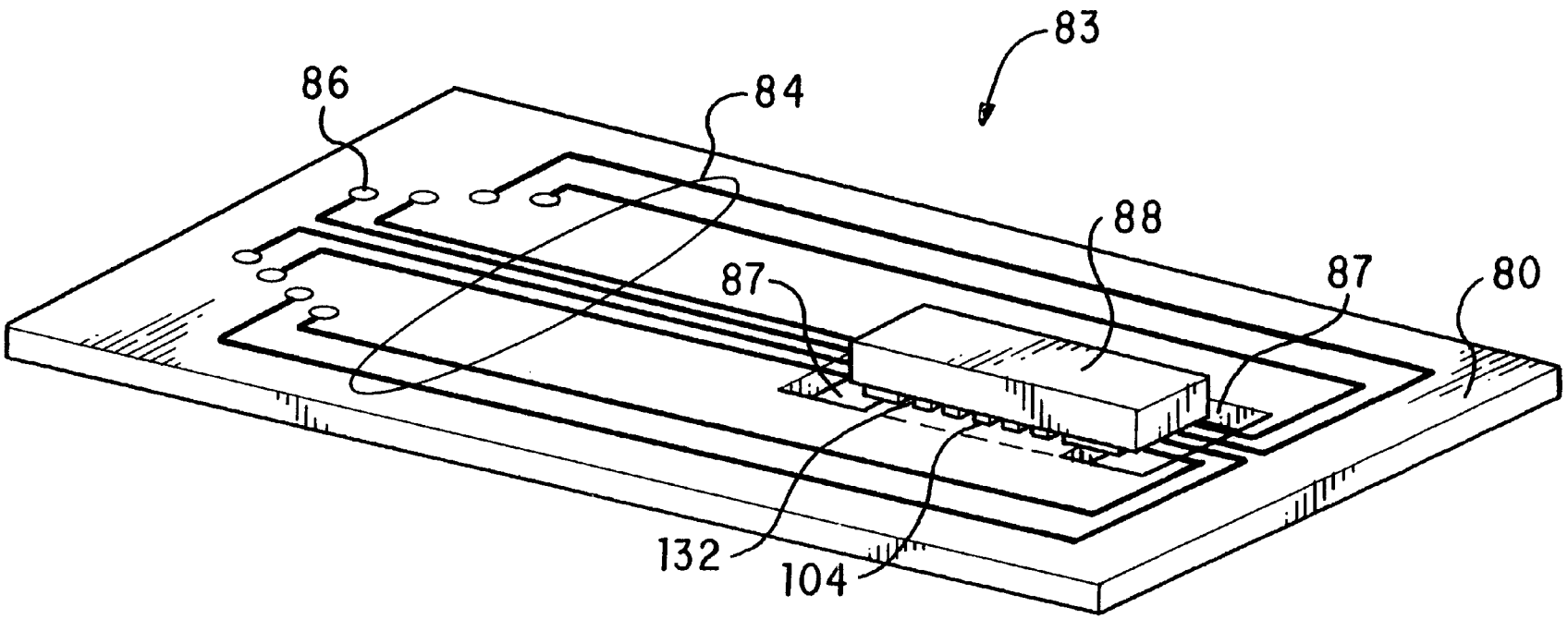
FIG. 4 is a schematic perspective view of the back side of a simplified printhead assembly.

Referring to FIGS. 3 and 4, printhead assembly 83 is preferably a flexible polymer tape 80 having a nozzle member array 79 containing nozzles 82 formed therein by laser ablation. Conductors 84 are formed on the back of tape 80 and terminate in contact pads 86 for contacting electrical contacts on carriage 16. The other ends of conductors 84 are bonded to electrodes 87 of substrate 88 on which are formed the various ink ejection chambers and ink ejection elements. The ink ejection elements may be heater ink ejection elements or piezoelectric elements.

A demultiplexer (not shown) may be formed on substrate 88 for demultiplexing the incoming multiplexed signals applied to the electrodes 87 and distributing the address and primitive signals to the various ink ejection elements 96 to reduce the number of contact pads 86 required. The incoming multiplexed signals include address line and primitive firing signals. The demultiplexer enables the use of fewer contact pads 86, and thus electrodes 87 than, ink ejection elements 96. The demultiplexer may be any decoder for decoding encoded signals applied to the electrodes 87. The demultiplexer has input leads (not shown for simplicity) connected to the electrodes 87 and has output leads (not shown) connected to the various ink ejection elements 96. The demultiplexer demultiplexes the incoming electrical signals applied to contact pads 86 and selectively energizes the various ink ejection elements 96 to eject droplets of ink from nozzles 82 as nozzle array 79 scans across the print zone. Further details regarding multiplexing are provided in U.S. Pat. No. 5,541,269, issued Jul. 30, 1996, entitled "Printhead with Reduced Interconnections to a Printer," which is herein incorporated by reference.

Preferably, an integrated circuit logic using CMOS technology should be placed on substrate 88 in place of the demultiplexer in order to decode more complex incoming data signals than just multiplexed address signals and primitive signals, thus further reduce the number of contact pads 86 required. The incoming data signals are decoded into address line and primitive firing signals and increase the speed of the signal processing.

Also formed on the surface of the substrate 88 using conventional photolithographic techniques is the barrier layer 104, which may be a layer of photoresist or some other polymer, in which is formed the ink ejection chambers 94 and ink channels 132.

Figure 5:
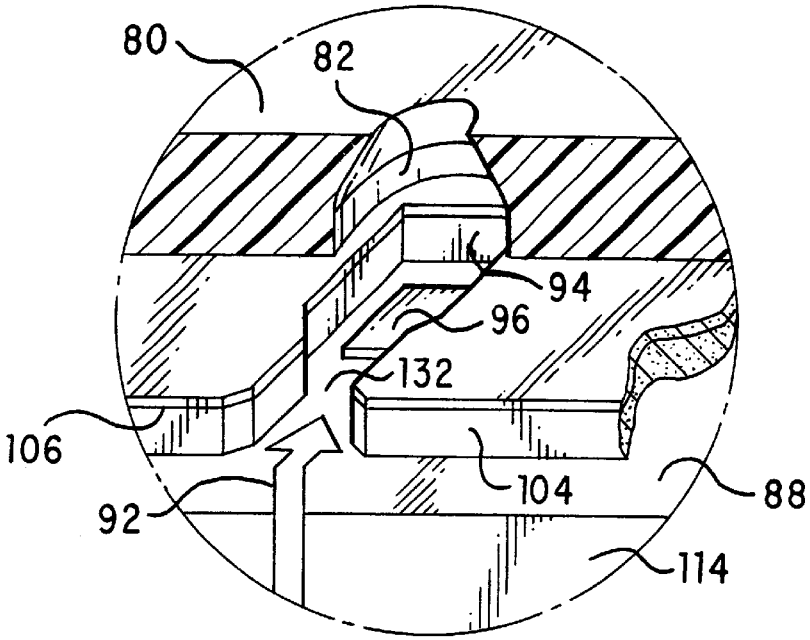
FIG. 5 is a top perspective view, partially cut away, of a portion of the TAB head assembly showing the relationship of an orifice with respect to a ink ejection chamber, a heater ink ejection element, and an edge of the substrate.

FIG. 5 is an enlarged view of a single ink ejection chamber 94, ink ejection elements 96, and frustum shaped orifice 82 after the substrate structure is secured to the back of the flexible circuit 80 via the thin adhesive layer 106. A side edge of the substrate 88 is shown as edge 114. In operation, ink flows from the ink reservoir 12 around the side edge 114 of the substrate 88, and into the ink channel 132 and associated ink ejection chamber 94, as shown by the arrow 92. Upon energization of the ink ejection element 96, a thin layer of the adjacent ink is superheated, causing ink ejection and, consequently, causing a droplet of ink to be ejected through the orifice 82. The ink ejection chamber 94 is then refilled by capillary action.

Figure 6:
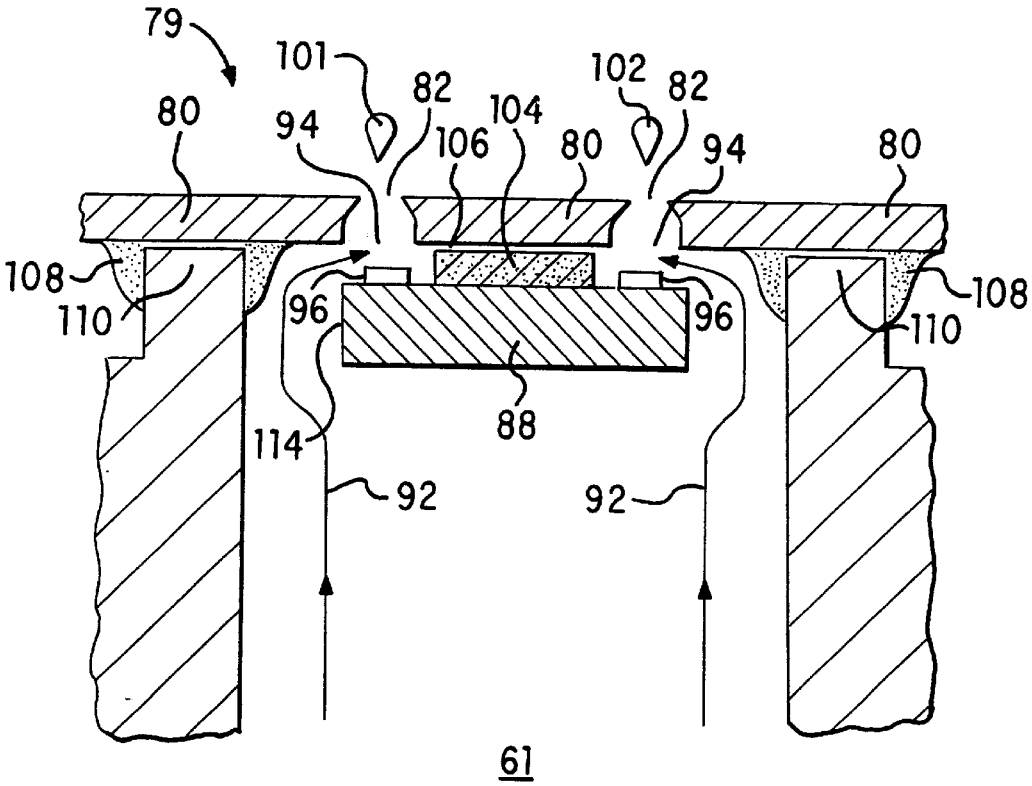
FIG. 6 is a cross-sectional view of the printhead assembly showing the flow of ink to the ink ejection chambers in the printhead.

FIG. 6 illustrates the flow of ink 92 from the ink chamber 61 within print cartridge 18 to ink ejection chambers 94. Energization of the ink ejection elements 96 cause a droplet of ink 101, 102 to be ejected through the associated nozzles 82. A photoresist barrier layer 104 defines the ink channels and chambers, and an adhesive layer 106 affixes the flexible tape 80 to barrier layer 104. Another adhesive 108 provides a seal between tape 80 and the plastic print cartridge body 110.

The assembly of the printhead may be similar to that described in U.S. Pat. No. 5,278,584, by Brian Keefe, et al., entitled "Ink Delivery System for an Inkjet printhead," assigned to the present assignee and incorporated herein by reference.

The frequency limit of a thermal inkjet pen is limited by resistance in the flow of ink to the nozzle. However, some resistance in ink flow is necessary to damp meniscus oscillation, but too much resistance limits the upper frequency at which a print cartridge can operate. The inlet channel geometry, barrier thickness, shelf length or inlet channel length which is the distance between the ink ejection elements and the edge of the substrate, must be properly sized to enable fast refill of ink into the ink chamber 94 while also minimizing sensitivity to manufacturing variations. As a consequence, the fluid impedance is reduced, resulting in a more uniform frequency response for all nozzles. An additional component to the fluid impedance is the entrance to the ink ejection chamber 94. The entrance comprises a thin region between the nozzle 82 and the substrate 88 and its height is essentially a function of the thickness of the barrier layer 104. This region has high fluid impedance, since its height is small.

To increase resolution and print quality, the printhead nozzles must be placed closer together. This requires that both heater ink ejection elements and the associated orifices be placed closer together. To increase printer throughput, the firing frequency of the ink ejection elements must be increased. When firing the ink ejection elements at high frequencies, conventional ink channel barrier designs either do not allow the ink ejection chambers to adequately refill or allow extreme blowback or catastrophic overshoot and puddling on the exterior of the nozzle member. Also, the closer spacing of the ink ejection elements create space problems and restricted possible barrier solutions due to manufacturing concerns.

Figure 7:
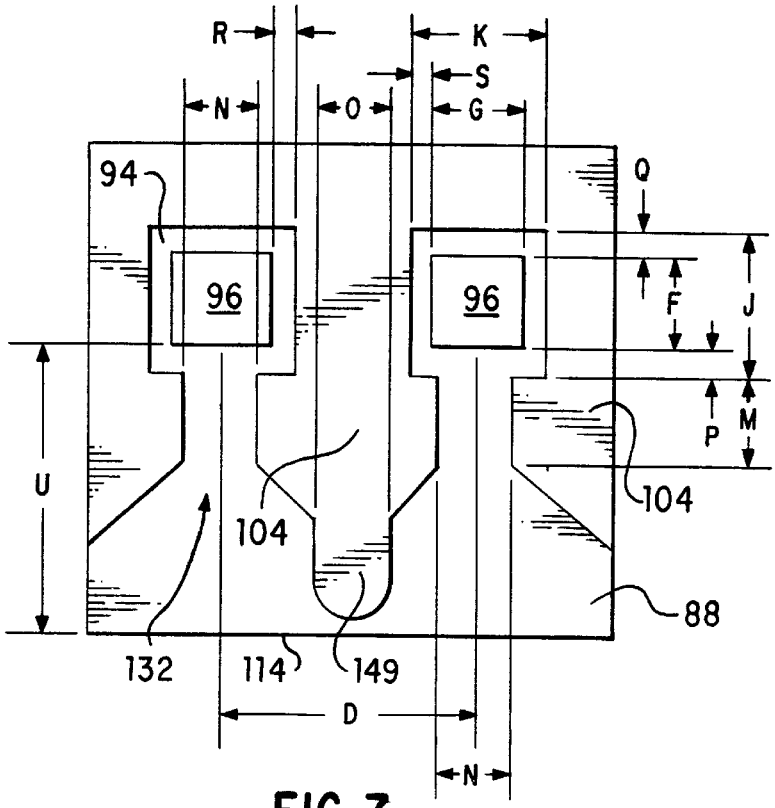
FIG. 7 is a top plan view of a magnified portion of a printhead showing two ink ejection chambers and the associated barrier structure and ink ejection elements.

FIGS. 7 an 8 show a printhead architecture that is advantageous when the printing of very high dot density, low drop volume, high drop velocity and high frequency ink ejection is required. However, at high dot densities and at high ink ejection rates cross-talk between neighboring ejection chambers becomes a serious problem. During the ejection of a single drop, initiated by an ink ejection element displaces ink out of nozzle 82 in the form of a drop. At the same time, ink is also displaced back into the ink channel 132. The quantity of ink so displaced is often described as "blowback volume." The ratio of ejected volume to blowback volume is an indication of ejection efficiency. In addition to representing an inertial impediment to refill, blowback volume causes displacements in the menisci of neighboring nozzles. When these neighboring nozzles are fired, such displacements of their menisci cause deviations in drop volume from the nominally equilibrated situation resulting in non-uniform dots being printed. An embodiment of the present invention shown in the printhead assembly architecture of FIG. 7 is designed to minimize such cross-talk effects.

The ink ejection chambers 94 and ink channels 132 are shown formed in barrier layer 104. Ink channels 132 provide an ink path between the source of ink and the ink ejection chambers 94. The flow of ink into the ink channels 132 and into the ink ejection chambers 94 is via ink flow around the side edges 114 of the substrate 88 and into the ink channels 132. The ink ejection chambers 94 and ink channels 132 may be formed in the barrier layer 104 using conventional photolithographic techniques. The barrier layer 104 may comprise any high quality photoresist, such as Vacrel™ or Parad™.

Ink ejection elements 96 are formed on the surface of the silicon substrate 88. As previously mentioned, ink ejection elements 96 may be well-known piezoelectric pump-type ink ejection elements or any other conventional ink ejection elements. Peninsulas 149 extending out to the edge of the substrate provide fluidic isolation of the ink ejection chambers 94 from each other to prevent cross-talk. The pitch D of the ink ejection chambers 94, shown below in Table II, provides for 600 dots per inch (dpi) printing using two rows of ink ejection chambers 94.

While the ink ejection elements and ink ejection chambers are shown as essentially being square in FIG. 7, it will be appreciated that they can be retangular or circular in shape.

Figure 8:
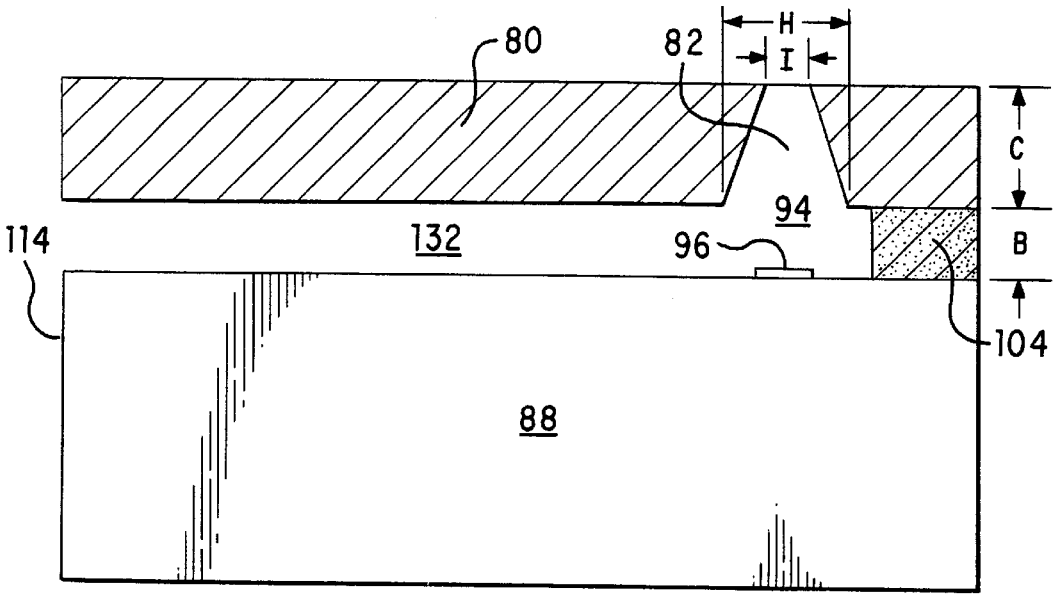
FIG. 8 is an elevational cross-sectional view of the printhead assembly of FIG. 7 showing the thickness of the barrier layer and the nozzle member.

The definition of the dimensions of the various elements shown in FIGS. 7 and 8 are provided in Table I.

TABLE I

DEFINITIONS FOR DIMENSIONS OF PRINTHEAD ARCHITECTURE

| Dimension | Definition |
|---|---|
| B | Barrier Thickness |
| C | Nozzle Member Thickness |
| D | Orifice/Ink Ejection Element Pitch |

TABLE I-continued

DEFINITIONS FOR DIMENSIONS OF PRINTHEAD ARCHITECTURE

| Dimension | Definition |
|---|---|
| F | Ink Ejection Element Length |
| G | Ink Ejection Element Width |
| H | Nozzle Entrance Diameter |
| I | Nozzle Exit Diameter |
| J | Chamber Length |
| K | Chamber Width |
| M | Channel Length |
| N | Channel Width |
| O | Barrier Peninsula Width |
| P | Entrance Chamber Gap |
| Q | Back Wall Chamber Gap |
| R | Side Chamber Gap |
| S | Side Chamber Gap |
| U | Inlet Channel Length |

Table II lists the nominal values, as well as their preferred ranges, of some of the dimensions of the printhead assembly structure of FIGS. 7 and 8. It should be understood that the preferred ranges and nominal values of an actual embodiment will depend upon the intended operating environment of the printhead assembly, including the type of ink used, the operating temperature, the printing speed, and the dot density.

TABLE II

INK CHAMBER DIMENSIONS IN MICRONS

| Dimension | Minimum | Nominal | Maximum |
|---|---|---|---|
| B | 8 | 14 | 20 |
| C | 15 | 25.4 | 39 |
| D | | 84.7 | |
| F | 11 | 17 | 23 |
| G | 11 | 17 | 23 |
| H | 24 | 34 | 44 |
| I | 8 | 12 | 14 |
| J | 20 | 27 | 38 |
| K | 20 | 27 | 38 |
| M | 15 | 30 | 45 |
| N | 12 | 20 | 30 |
| O | 10 | 23 | 40 |
| P | 2 | 6 | 12 |
| Q | 2 | 6 | 9 |
| R | 2 | 5 | 9 |
| S | 2 | 5 | 9 |
| U | 70 | 160 | 220 |

FIGS. 7 and 8 and Table II show the design features and dimensions characteristics of printheads which can be used to successfully print photographic quality images at a high drop velocities and a constant small drop volume of less than 10 picoliters. The printhead architecture design is a key factor of the present invention. Flex circuit 80 thickness has to be matched to the dimensions of the ink channel 132, ejection chamber 94, ink ejection element 96, barrier 104 thickness and design, as well as the ink formulation. Simply reducing the horizontal dimensions F, G, H, I, J and K of the ink chamber 94 reduces the volume of the ejected drops, but creates a low drop ejection velocity. Referring to Table III, a standard 2-mil. (50.8 micron) flex circuit 80 and a nozzle outlet diameter of 14 microns creates a long nozzle with a C/I of approximately 4.0. Consequently, drops are ejected at a velocity of approximately 3.5–7.5 meters/second which is too low. These low velocity drops can lead to nozzle plugs, mis-direction, and thermal inefficiency.

TABLE III

| Nozzle Thickness C | Barrier Thickness B | Orifice Diameter I | Resistor Size F, G | C/I | Drop Volume Picoliters | Drop Velocity meters/sec |
|---|---|---|---|---|---|---|
| 50.8 | 14 | 14 | 17 | 3.6 | 3.5 | 3.0 |
| 50.8 | 14 | 14 | 21 | 3.6 | 5.9 | 7.5 |
| 25.4 | 14 | 12 | 17 | 2.1 | 5.3 | 14.0 |

Referring to again to Table III, the ink ejection chamber 94 can eject small drops in high frequency bursts when the nozzle 82 thickness is matched to ink ejection element 96 size, barrier 104 thickness, and nozzle 82 exit diameter. As shown in Table III, drop velocity is nearly doubled when the nozzle 82 or flex circuit 80 thickness is reduced from 50.8 microns to 25.4 micron. The surprising result of using a 25.4-micron flex circuit 80 or nozzle 82 leads to a robust, reliable design that is thermally efficient.

The present invention has several advantages over previous printing systems and methods. The drop volume and velocity of the individual drops in high frequency bursts in the range of 15 to 60 kHz remain nearly constant at approximately 3–5 picoliters (pl) and velocities greater than 10 meters per second (m/s), respectively. In previous printhead architectures the first drop ejected from the ink ejection chamber 94 was the largest and slowest drop. Successive drops after the first ejected drop were significantly lower in volume. However, to create a smooth gray level ramp, it is desirable to have precisely the opposite effect, i.e., a smaller, nearly imperceptible first drop, followed by successive drops of larger cummulative volume. In addition, drops with low velocity are undesirable because they cannot clear mild nozzle plugs and are easily misdirected by puddles on the nozzle member surface.

Another advantage of the present invention is that the design of the ink ejection chamber and ink inlet channel allows for high frequency ink refill of the ink ejection chamber. The ink ejection chamber refill frequency must at least equal to the ink ejection frequencies of 15 to 60 kHz.

Another advantage of the present invention is that drop velocity and volume are much less sensitive to ink viscosity and surface tension. Previous multi-drop architectures required higher viscosity ink (approximately 10 centipoise) and higher surface tension (approximately 50 dynes/cm), e.g., a 70% diethylene glycol/30% $H_2O$ mix. Such inks also required the use of paper which is not acceptable for photographic quality imaging. The present invention can use inks which have a viscosity of approximately 1.5 centipoise and a surface tension of approximately 25 dynes/cm. This allows the use of a gelatin or voided media that closely resembles the paper used in the 35 mm film/photo industry. Less sensitivity to ink properties also permits flexibility in designing an ink that will dry relatively quickly, but does not compromise overall reliability.

Other advantages of the present invention are: (1) individual drops remain nearly constant in volume for bursts of one to eight drops at high frequencies. This allows smooth gray level ramps, which is a fundamental requirement in high quality imaging, and (2) does not require ink viscosity and dynamic surface tension that are incompatible with imaging media, lightfastness, waterfastness, and dry time goals.

While particular embodiments of the present invention have been shown and described, it will be obvious to those skilled in the art that changes and modifications may be made within departing from this invention in its broader aspects and, therefore, the appended claims are to encompass within their scope all such changes and modifications as fall within the true spirit and scope of this invention.

What is claimed is:

1. An inkjet print cartridge, comprising:

an ink supply;

a substrate;

a plurality of individual ink ejection chambers defined by a barrier layer formed on said substrate and having an ink ejection element in each of said ink ejection chambers for ejection drops of ink having substantially constant, predetermined drop volume and drop velocity, said ink ejection chambers each having an inlet channel and said ink ejection chambers arranged in an array spaced so as to provide a predetermined resoulution;

a plurality of nozzles having a plurality of ink orifices formed therein, said nozzles being positioned to overlie said barrier layer with said orifices aligned with said ink ejection chambers, wherein said nozzles have a thickness matched to a size of said ink ejection element and the thickness of said barrier layer; and an ink channel connecting said supply of ink with said inlet channel.

2. The inkjet print cartridge of claim 1 wherein said predetermined drop volume is less than 10 picoliters and said predetermined velocity is greater than 15 meters per second.

3. The inkjet print cartridge of claim 1 wherein said predetermined drop volume is less than 10 picoliters.

4. The inkjet print cartridge of claim 1 wherein said predetermined drop volume is between approximately 3 to 5 picoliters.

5. The inkjet print cartridge of claim 1 wherein said predetermined velocity is greater than 10 meters per second.

6. The inkjet print cartridge of claim 1 wherein said predetermined drop volume is less than 4 picoliters and said predetermined velocity is greater than 15 meters per second.

7. The inkjet print cartridge of claim 1 wherein said predetermined resolution is greater than 600 dots per inch.

8. The inkjet print cartridge of claim 1 wherein said ink chamber is arranged in a first chamber array and a second chamber array and said ejection chambers spaced so as to provide greater than 600 dots per inch resolution.

9. The inkjet print cartridge of claim 1 wherein said chamber includes a primary channel connected at a first end with said ink supply and at a second end to said inlet channel formed in the barrier layer and connected to said ink ejection chamber for each of said ejection chambers, said inlet channels allowing high frequency refill of the ink ejection chamber.

10. The inkjet print cartridge of claim 9 wherein said high frequency refill of the ink ejection chamber is greater than 20 kHz.

11. The inkjet print cartridge of claim 9 wherein said high frequency refill of the ink ejection chamber is between 15 and 60 kHz.

12. The inkjet print cartridge of claim 1 wherein said nozzle thickness is less than 20 microns.

13. The inkjet print cartridge of claim 1 wherein said drops of ink are ejected at high frequency bursts between approximately 15 to 60 kHz.

14. The inkjet print cartridge of claim 1 wherein said drops of ink are ejected at high frequency bursts greater than 20 kHz and smaller than approximately 60 kHz.

15. The inkjet print cartridge of claim 1 wherein said thickness of said plurality of nozzles is approximately 1 mil.

16. An inkjet print cartridge comprising:

a substrate;

a plurality of individual ink ejection chambers of a predetermined size and defined by a barrier layer of a given thickness formed on said substrate and having an ink ejection element of a predetermined size in each of said ink ejection chambers for ejecting drops of ink;

said ink ejection chambers each having an inlet channel and said ink ejection chambers arranged in an array spaced so as to provide a predetermined resolution; and a nozzle array including a plurality of nozzles, each having a given thickness of approximately 1 mil, having a plurality of ink orifices formed therein, said nozzle array being positioned to overlie said barrier layer and having said orifices aligned with said ink ejection chambers to generate a substantially constant drop volume and drop speed.

17. The inkjet print cartridge of claim 16 wherein said ink ejection chamber occupies an area on said first surface of the substrate between 400 and 1440 square microns.

18. The inkjet print cartridge of claim 16 wherein said ink ejection element occupies an area on said substrate between 120 and 530 square microns.

19. The inkjet print cartridge of claim 16 wherein said barrier layer has a thickness between 8 and 20 microns.

20. The inkjet print cartridge of claim 16 wherein said nozzle array has inlet and outlet nozzle diameter.

21. The inkjet print cartridge of claim 20 wherein said nozzle array has an inlet nozzle diameter of 24 to 44 microns.

22. The inkjet print cartridge of claim 20 wherein said nozzle array has an outlet nozzle diameter of 8 to 14 microns.

23. The inkjet printer of claim 16 further comprising, an ink supply, and an ink channel connecting said ink supply to said inlet channel.

24. An inkjet printer comprising:

a scanning carriage;

a substrate mounted in said scanning carriage;

a plurality of individual ink ejection chambers defined by a barrier layer formed on said substrate and having an ink ejection element in each of said ink ejection chambers for ejecting drops of ink having substantially constant, predetermined drop volume and drop velocity;

said ink ejection chambers each having an inlet channel and said ink ejection chambers arranged in an array spaced so as to provide a predetermined resolution;

a nozzle array including a plurality of nozzles and having a plurality of ink orifices formed therein, said nozzle array being positioned to overlie said barrier layer with said orifices aligned with said ink ejection chambers, wherein said nozzles have a thickness matched to a size of said ink ejection element and the thickness of said barrier layer;

a supply of ink; and an ink channel connecting said supply of ink with said inlet channel.

25. The inkjet print cartridge of claim 24 wherein said approximately constant drop volume and drop velocity are generated between 10 to 60 kHz.

26. The inkjet printer of claim 24 wherein said predetermined drop velocity is greater than 10 meters per second.

27. The inkjet print cartridge of claim 24 wherein said drops of ink are ejected at high frequency bursts greater than 20 kHz and smaller than approximately 60 kHz.

28. The inkjet printer of claim 24 wherein said thickness of said nozzles is approximately 1 mil.

* * * * *